United States Patent [19]

Nakhle et al.

[11] 4,364,320

[45] Dec. 21, 1982

[54] GARMENT TOE CLOSING SYSTEM

[75] Inventors: George D. Nakhle; Cecil R. Bell, both of Pinnacle; Arthur R. Edwards, Winston-Salem; Willie M. Lathery, Germanton; Navin D. Patel., Winston-Salem, all of N.C.

[73] Assignee: Consolidated Foods Corporation, Winston-Salem, N.C.

[21] Appl. No.: 236,884

[22] Filed: Feb. 23, 1981

[51] Int. Cl.[3] ..... D05B 19/00; D05B 21/00

[52] U.S. Cl. ..... 112/262.2; 112/121.15

[58] Field of Search ..... 112/262.2, 121.12, 121.15, 112/121.11, 121.29; 223/112

[56] References Cited

U.S. PATENT DOCUMENTS

| | | | |
|---|---|---|---|
| 3,738,294 | 6/1973 | Christiansen | 12/121.15 |
| 3,859,938 | 1/1975 | Fukuyama | 112/121.15 |
| 3,941,069 | 3/1976 | Fukuyama | 112/262.2 |
| 4,133,276 | 1/1979 | Selvi | 112/121.15 |

*Primary Examiner*—H. Hampton Hunter

*Attorney, Agent, or Firm*—Charles Y. Lackey; William S. Burden

[57] ABSTRACT

A system for automatically closing the toe portions of tubular hosiery blanks includes an automatic loader assembly for receiving, supporting and spreading open an end portion of a hosiery blank, for transporting the blank to a toe closing machine, and for carrying the opened end of the blank over a loading tube of a toe closing machine while everting the blank.

12 Claims, 8 Drawing Figures

GARMENT TOE CLOSING SYSTEM

BACKGROUND, BRIEF SUMMARY AND OBJECTS OF THE INVENTION

The present invention is directed to an apparatus for and method of handling and closing one end of circular knit hosiery blanks.

It has become a common practice to close the toe portions of hosiery blanks by guiding the blanks to a sewing machine. Several automatic machines for carrying out the toe closing operation on a plurality of hosiery blanks by sucessive operational steps are disclosed, for example, by U.S. Pat. Nos. 3,941,069 and 3,859,938. Normally an operator picks up the welt portion of a hosiery blank and holds the toe end in front of a suction tube so as to draw the toe end of the blank into the tube. The operator then draws the blank from within the tube over the outside of the tube thus everting the blank. At the same time the toe end portion is positioned at a specific location on the tube.

In the present invention, a number of the manual operations required in positioning a blank on a loading tube have been eliminated, thus the loading operations are carried out with a minimum of labor.

In one embodiment of the invention, the system includes a hosiery blank support unit having loading fingers displacable in a circular path about a hub. A binder or clamp is attached to a first loading finger for retaining the welt portion of the blank. The loading fingers expand in response to a fluid cylinder to spread the welt portion. A drive motor displaces the garment to a position where the toe end of the blank is drawn by suction into a loading tube. Continued displacement of the blank carries the blank over the exterior of the tube. The loading fingers then collapse, leaving the blank on the tube. The support unit and loading fingers continue to rotate to the original starting position ready to accept a new hosiery blank.

In an alternate embodiment, a plurality of blank support units radiate from the hub. The hub and support units may be controlled to rotate continuously at a selected speed or at intermittent steps having a selected time interval between successive steps.

One of the primary objects of the invention is the provision of a system for loading hosiery blanks onto loading tubes of an automatic toe closing machine.

Another object of the invention is the provision of a novel arrangement for carrying out the loading of blanks with increased productivity by eliminating certain manual operations.

Still another object of the invention is the provision of a new and improved system for decreasing operating costs.

Other objects and advantages of the invention will become apparent when considered in view of the following detailed description.

IN THE DRAWING

DETAILED DESCRIPTION OF THE INVENTION

Figure 1:
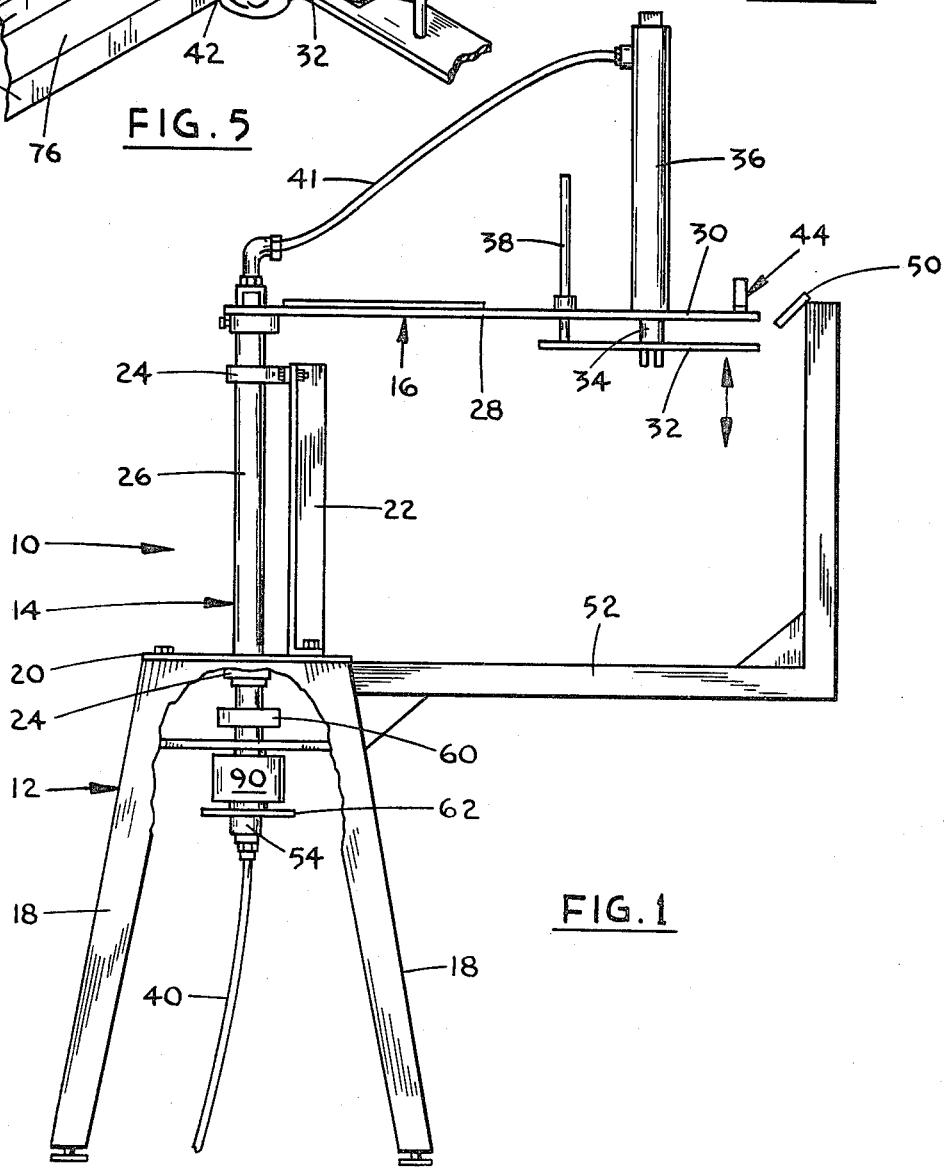
FIG. 1 is a side elevational view of one embodiment of the loading apparatus of the present invention.

Referring to FIG. 1, the mechanism 10 for positioning hosiery blanks upon the loading tubes of an automatic toe closing machine includes a support structure 12, a hub assembly 14 and a blank support unit 16.

The support structure 12 consists of a stand having legs 18 and a plate 20, and an upright bracket 22 secured to the plate 20. Attached to the upper end of bracket 22 and to the base plate 20 are a pair of shaft bearings 24,24 for rotatably blade supporting the hub assembly 14.

Figure 5:
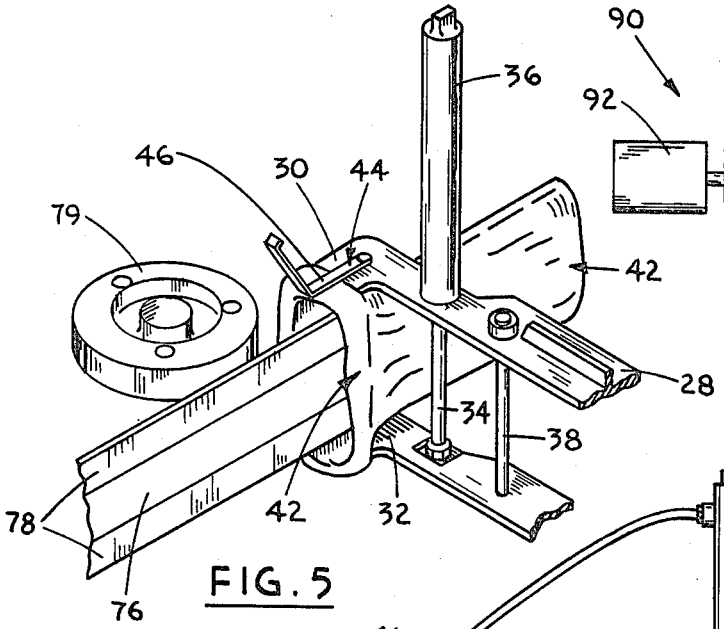
FIG. 5 is an enlarged view of the expanded loading fingers as they displace a blank over the loading tube.
Figure 6:
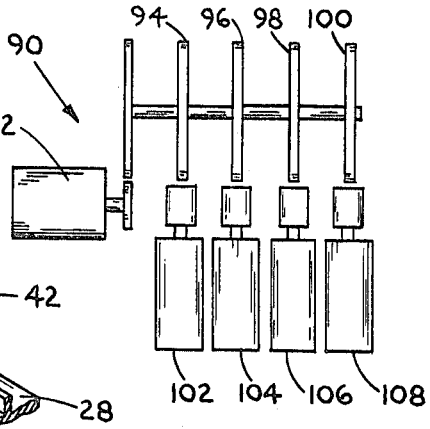
FIG. 6 is a schematic diagram of the program motor and control cams.

The hub assembly 14 includes a vertically disposed hollow shaft 26 which has the support unit 16 attached to the upper end thereof. An arm 28 of the support unit is fixedly secured adjacent one end to the upper end of shaft 26 for rotation therewith. The other end of the arm 28 is generally L-shaped, as shown most clearly by FIGS. 2, 4 and 5 and defines a loading finger 30. A second finger 32, corresponding generally in size and configuration to that of finger 30, is mounted in vertically spaced parallel relation with finger 30. The finger 32 is attached to the piston rod 34 of the fluid cylinder 36, which, in turn, is fixedly secured to the arm 28. A guide rod 38 is secured to the displacable finger 32 and extends through an opening in the arm 28 for providing stability to the finger 32 and for retaining such finger in alignment with the finger 30. Attached to the upper finger 30 is a clamp or binder element 44 for retaining a hosiery blank 42 upon the support unit when the fingers are in the collapsed position. The clamp 44, FIG. 5, may be of spring steel construction having a generally L-shaped configuration and having a portion 46 normally biased into engagement with the upper surface of finger 30. In placing a hosiery blank 42 on the support unit 16, the blank welt end is placed between the binder clamp surface 46 and the upper surface of finger 30 and depends below the finger 32. Upon activation of the air cylinder 36 the fingers expand, thus opening the welt end of the blank.

Figure 4:
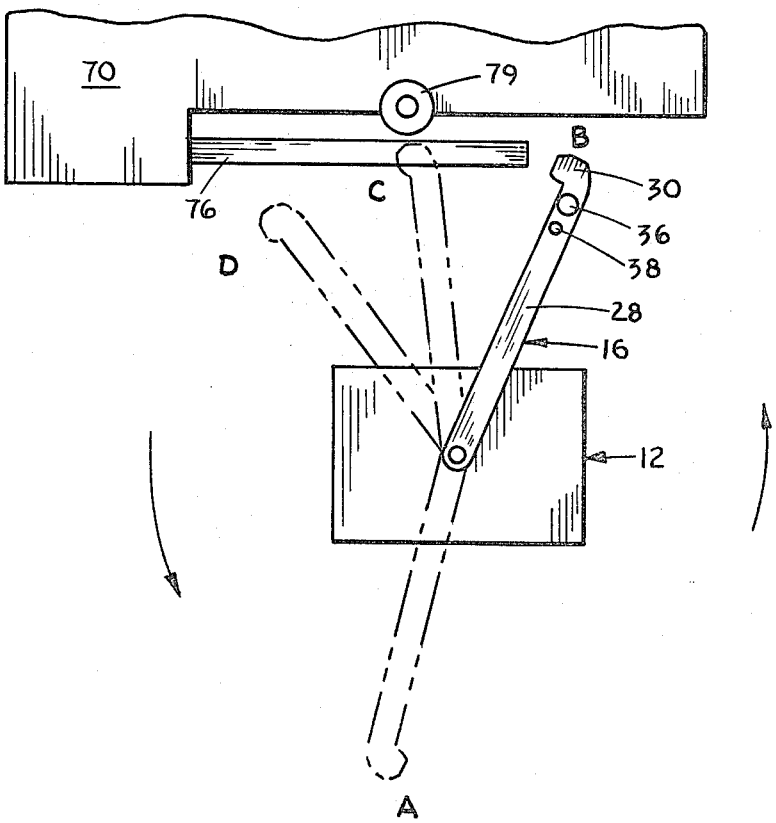
FIG. 4 is a schematic, fragmentary, top plan view of the loading unit of FIG. 1.
Figure 8:
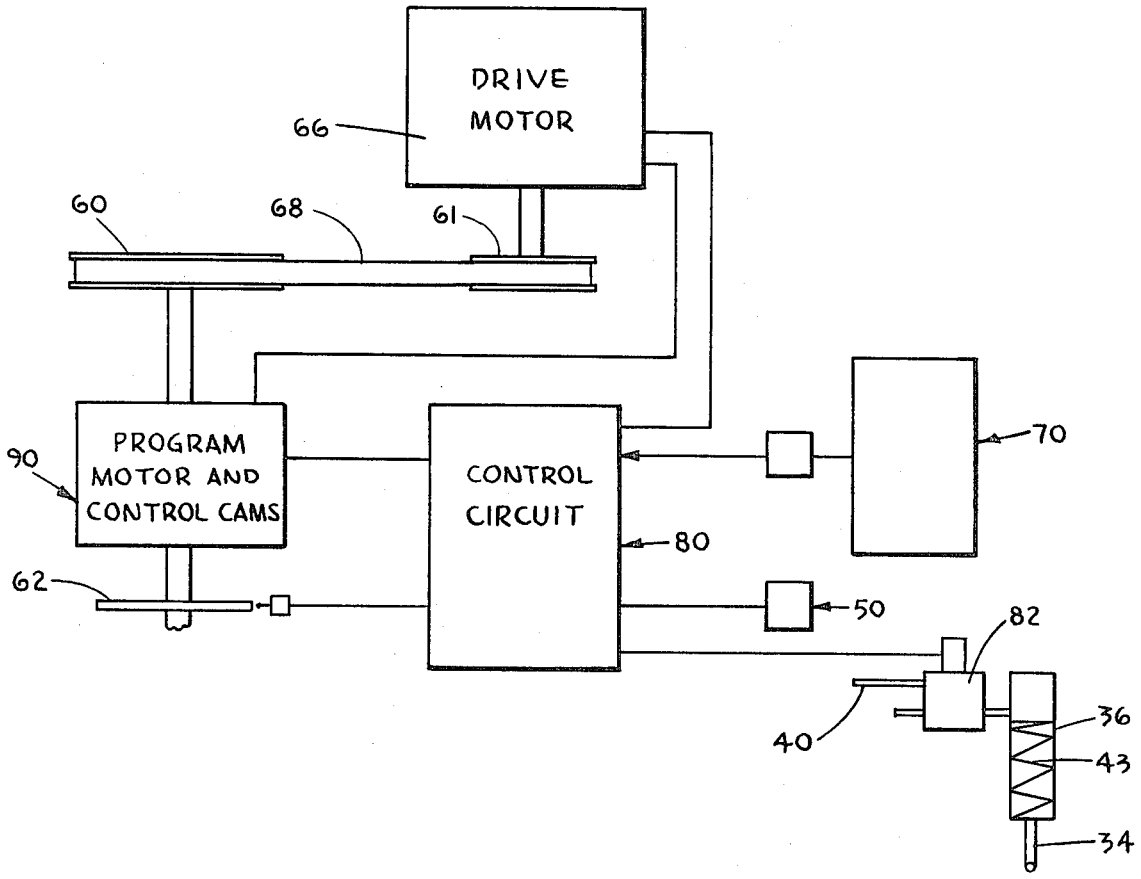
FIG. 8 is a schematic block diagram of the various control components.

A sensor 50, which may be a photo electric switching device, is positioned to be adjacent to fingers 30, 32 when the support unit 16 is in the loading position A, FIG. 4. The sensor may be fixedly supported by any siutable means. In the embodiment illustrated, the sensor 50 is supported upon a bracket 52 secured to the stand 12.

The cylinder 36, which controls displacement of the fingers 30, 32 between expanded and collapsed positions, is activated by conventional valve 39 which controls air flow through supply line 40, a rotary union 54 connected to the lower end of the hollow shaft 26, the shaft 26, and the air line 41. The fluid cylinder is of the type provided with a return spring 43.

The shaft 26 has a pulley 60 and a drive cam 62 secured to the lower end thereof. The support unit 16 shaft 26, and cam 62 are selectively indexed in a prescribed manner from a drive motor 66, belt 68 and drive pulleys 60, 61.

Figure 2:
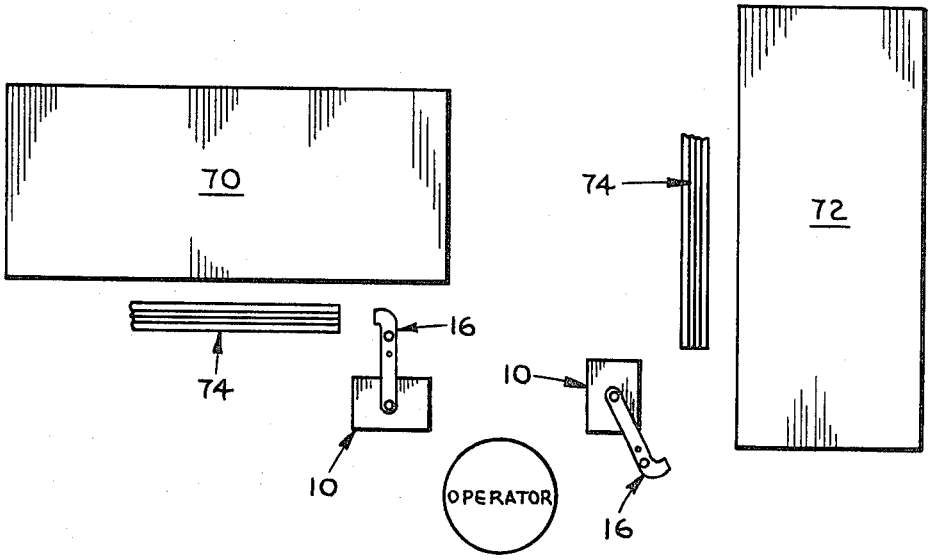
FIG. 2 is a schematic, diagrammatic top plan view of the loading mechanisms, two automatic toe closing machines and the location of an operator for positioning hosiery blanks upon the loading fingers.
Figure 3:
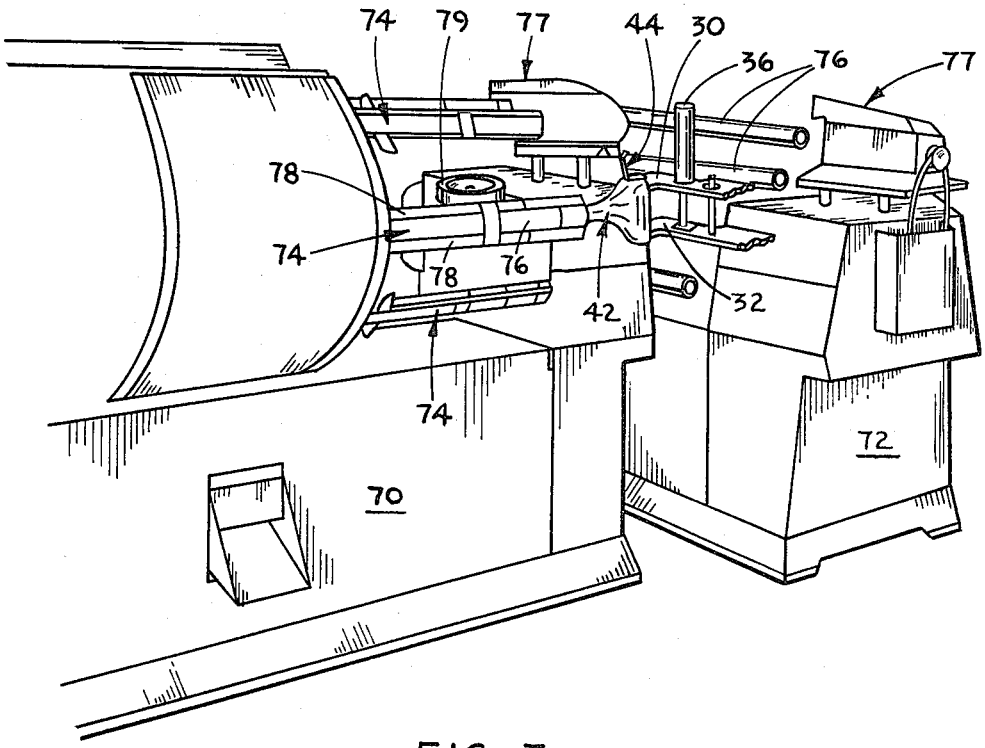
FIG. 3 is a fragmentary, perspective view of the positioning of two automatic toe closer machines, and also illustrating the opened loading fingers prior to displacing a blank over a loading tube.

The loading apparatus 10 is used in conjunction with automatic toe closing mechanisms. Referring to FIGS. 2 and 3, automatic toe closing machines 70, 72 are provided. The machines may be of a type manufactured by Takatori Machinery Works, Inc., and as disclosed by U.S. Pat. No. 3,941,069. Each toe closer is provided with a plurality of support units 74, each of which includes an elongated tube 76 having opposed finger pieces 78 capable of being axially selectively displaced relative thereto. Wind on wheels 79 position the blanks on the tubes, and the finger pieces 78 are projected to present the toe end of the blanks to sewing instrumentalities 77.

In the operation of the system, the arm 28 and fingers 30, 32 are initially at rest at position A, FIG. 4, and with the fingers 30,32 in a collapsed condition.

An operator picks up a garment blank 42 and inserts a portion of the welt end between the finger 30 and the spring clip 46. Since the fingers are collapsed, the lower finger 32 also is within the open end of the hosiery blank 42.

At the instant the blank is clamped by the spring clip, a photo electric switching device 50 senses the blank and through a control circuit 80, solenoid valve 82 and cylinder 36, the finger 32 is moved away from finger 30 to stretch or open the welt end of the hosiery blank, as shown by FIG. 3. Also at this time, a signal is received from the control circuit of a toe closer machine 70 to operate momentarily through control circuit 80 to remove the motor braking circuit and apply power to the drive motor 66. As the motor operates, drive cam 62 is rotated to maintain power to the drive motor. After approximately 100 degrees rotation of the drive cam, arm 28 and fingers 30, 32 having the blank thereon move to the position B, FIG. 4, the cam deactivates through circuit 80 power to the drive motor 66 and the motor brakes are reapplied.

With the fingers 30, 32 in position B, the toe closer 70 operates in a conventional manner and a loading tube 76 is indexed into position and suction in the tube picks up the blank toe portion drawing it into the tube, as show by FIG. 3, for subsequent everting of the blank. The control circuit 80 then activates the sequence program circuit 90 which includes the motor 92 and control cams 94–100 and their respective switches 102, 104, 106, 108. As the motor 92 rotates the cams, switch 104 is closed thus activating the driving motor 66 to move the fingers 30, 32 and blank 42 to position C. As the arm 28, and fingers 30, 32 are displaced the open or stretched welt end of the blank is moved over and along the outside of the loading tube 76 toward the wind-on wheels 79. As the blank reaches the wind-on wheels, switch 106 is operated deactivating the drive motor 66. The wind-on wheels 79 strip the blank 42 from fingers 30, 32 and wind the blank completely on the tube 76 for subsequent positioning of the blank toe portion for sewing. Upon continued rotation of the motor 92 and the cams 94–100, switch 106 is again operated energizing drive motor 66 thus rotating the arm 28 and fingers 30, 32. Continued rotation of the cams operate switch 108 which through the control circuit 80 solenoid valves 82 and fluid cylinder 36 causes the fingers 30, 32 to close at position D. The sequence program motor 92 has now completed one revolution and stops. The drive motor 66 continues rotation of the arm 28 and fingers 30, 32 to position A. The drive cam 62 deactivates the drive motor 66 at position A when the arm 28 and the fingers complete one full revolution. The fingers in the collapsed condition are now ready to receive another hosiery blank.

In the past, an operator has been required for each toe closing machine. With the use of the automatic loading assembly of the present invention an operator may operate more than one machine. As shown, for example by FIG. 2, an operator may be positioned adjacent plural, selectively located, automatic loading assemblies 10, 10A and toe closure machines 70, 72 for picking up hosiery blanks from a point and alternately placing the blanks on the rotating support units 16, 16A. Rather than having an operator load an automatic loading assembly, a robot may be provided for picking up blanks arranged in a prescribed manner at a supply station and placing the welt end of the blank on the loading assembly for subsequent spreading of the welt end by the fingers 30, 32.

Figure 7:
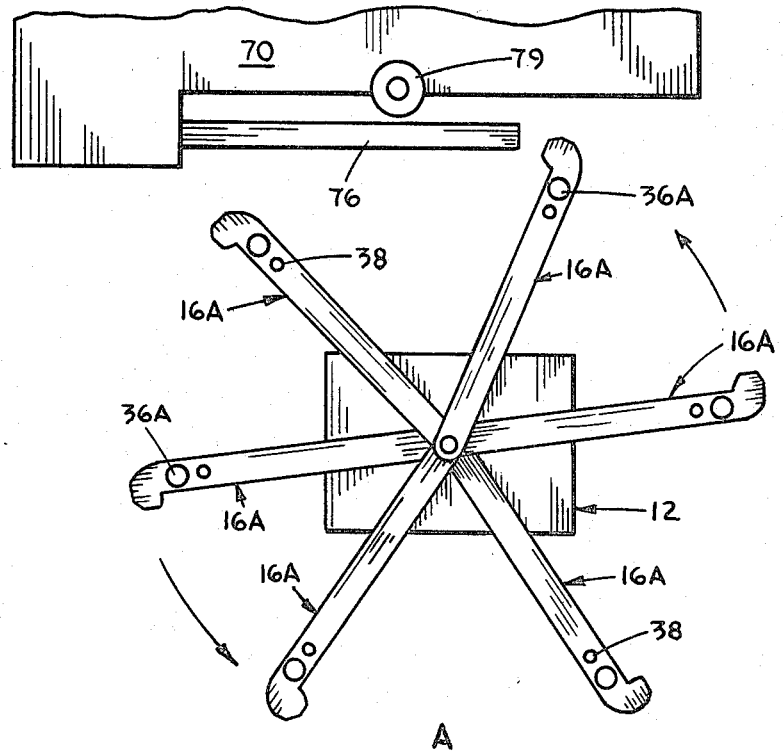
FIG. 7 is a top plan view of a modified loading apparatus of the present invention illustrating a plurality of equally spaced loading support arms and loading fingers.

Referring to FIG. 7, the automatic loading mechanism may include a plurality of hosiery blank support units 16A attached to a common hub assembly. The support unit 16A may be controlled to rotate continuously at a selected speed on in intermitant steps having a selected time interval between successive steps. In the embodiment of FIG. 7, the support units 16A are loaded simultaneously by an operator or robot each time a support unit indexes or rotates passed the loading station A. While six support units 16A have been shown, it is to be understood that the number of units may be varied depending on the operational speed of the hub assembly, the operational speed of the indexing tube 76 of the toe closing machine, etc.

What is claimed is:

1. A method of closing an open portion of a tubular hosiery blank having a welt end and a toe end comprising the steps of; transferring a hosiery blank from a supply station to a hosiery blank loading station, supporting the welt end portion of the hosiery blank in a prescribed manner, spreading open the welt end portion of the blank, transferring the blank from the loading station to a suction tube of a hosiery blank holding unit, positioning the hosiery blank upon the suction tube, presenting the toe portion of the hosiery blank to sewing instrumentalities, and sewing closed the blank toe end.

2. The method as recited in claim 1, wherein the welt end portion of the hosiery blank is supported by gripping an outer peripheral edge portion of the welt end.

3. The method as recited in claim 2, wherein the welt end of the blank is spread open by retaining the gripped peripheral edge portion in a fixed position and expanding the remaining peripheral portions of the welt end away from said gripped portion.

4. The method as recited in claim 2, wherein the hosiery blank is positioned upon a suction tube by transferring the gripped blank to a location adjacent the suction tube where suction draws a toe end portion of the blank into the tube, and the blank is further displaced, welt end first, over the suction tube to a prescribed location, and released.

5. In an apparatus for sequentally presenting tubular hosiery blanks having a welt end and a toe end to a toe closing machine having a support tube, support means, a hub assembly rotatable upon said support means, and a hosiery blank support unit secured to said hub assembly for displacement along an arcuate path, said support unit including means for gripping and expanding a hosiery blank welt end portion and means for selectively displacing the blank in a prescribed manner to position the blank upon a toe closing machine support tube.

6. Apparatus as recited in claim 5, said means for gripping and expanding a hosiery blank welt end portion including at least one arm means extending generally radially for said hub assembly and finger means supported by said arm means for displacement in a arcuate path.

7. Apparatus as recited in claim 6, wherein said finger means includes superposed, vertically spaced, aligned first and second fingers, said fingers being capable of vertical displacement relative to each other between expanded and collapsed positions.

8. Apparatus as recited in claim 7, wherein said first finger is integral with said arm means, and means supported by said arm means for displacing said second finger relative to said arm means.

9. Apparatus as recited in claim 6, said means for selectively displacing said blank in an arcuate path including means for rotating said hub assembly at a selected speed in intermittent steps.

10. Apparatus as recited in claim 5, wherein said hosiery blank support unit includes a plurality of arm means supported by and radiating from said hub assembly, each arm means including a pair of aligned, vertically spaced fingers, and fluid cylinder means for displacing vertically one of said fingers relative to the other finger.

11. In an automatic apparatus for seaming of tubular hosiery blanks having a welt portion at one end and a toe portion at the opposite end comprising a support assembly, a hub assembly rotatable upon said support assembly, hosiery blank support means secured to said hub assembly for rotary displacement, said support means including at least one arm means extending generally radially from said hub assembly, said arm means including vertically spaced, aligned, first and second fingers and means for retaining a hosiery blank welt portion upon said fingers, said support means further including means for expanding or collapsing said fingers, means for displacing said fingers in an expanded condition and having a hosiery blank thereon in a arcuate path, a displaceable tube for receiving the hosiery blank on the outer peripheral portions thereof, means for facilitating removal of the blank from said fingers, means for presenting the toe portions of the blanks supported upon said displacable tube to sewing instrumentalities for sewing closed the toe portion.

12. In an automatic apparatus as recited in claim 11, wherein the blank welt portion is held in an expanded condition by said fingers, and further including suction means for everting the blank by initially drawing the toe portion of the blank into said displacable tube, and displacing said expanded fingers along said arcuate path and generally opposite portions of said suction tube, said means of facilitating removal of said blank from said fingers includes a drive wheel for engaging and pulling the blank onto the suction tube and from said fingers.

* * * * *